US009708743B2

(12) United States Patent
Hwang et al.

(10) Patent No.: US 9,708,743 B2
(45) Date of Patent: Jul. 18, 2017

(54) WALL-MOUNTED DRUM-TYPE WASHING MACHINE

(71) Applicant: Dongbu Daewoo Electronics Corporation, Seoul (KR)

(72) Inventors: Ui Kun Hwang, Bucheon-si (KR); Ju Dong Lee, Incheon (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 678 days.

(21) Appl. No.: 14/119,437

(22) PCT Filed: Dec. 6, 2012

(86) PCT No.: PCT/KR2012/010513
§ 371 (c)(1),
(2) Date: Nov. 21, 2013

(87) PCT Pub. No.: WO2013/085292
PCT Pub. Date: Jun. 13, 2013

(65) Prior Publication Data

US 2014/0102150 A1 Apr. 17, 2014

(30) Foreign Application Priority Data

Dec. 8, 2011 (KR) ..... 10-2011-0131335
Dec. 30, 2011 (KR) ..... 10-2011-0146687

(51) Int. Cl.
*D06F 39/12* (2006.01)
*D06F 37/26* (2006.01)
(Continued)

(52) U.S. Cl.
CPC ..... *D06F 37/267* (2013.01); *D06F 37/262* (2013.01); *D06F 39/04* (2013.01);
(Continued)

(58) Field of Classification Search
CPC ..... D06F 37/267; D06F 39/12; D06F 39/083; D06F 39/125; D06F 37/22
(Continued)

(56) References Cited

U.S. PATENT DOCUMENTS 2,292,787 A * 8/1942 Johnson ..... D06F 21/02 68/144
3,471,940 A * 10/1969 Smith ..... D06F 58/04 34/139
(Continued)

FOREIGN PATENT DOCUMENTS

KR 200305578 Y1 * 2/2003
KR 20060125298 A * 12/2006
(Continued)

OTHER PUBLICATIONS

Kim, Sung Gon, "Wall Tapestry Small Drum Washing Machine" Feb. 2003, KR 200305578 Machine Translation.*
(Continued)

*Primary Examiner* — David Cormier
*Assistant Examiner* — Thomas Bucci

(57) ABSTRACT

A wall-mounted drum type washing machine includes a rear panel forming a rear surface of a cabinet, comprising a water supply device installed to supply wash water and a driving unit to provide power for a washing operation, mounted on a wall surface; a tub in the cabinet to contain wash water, integrated with the rear panel, and having a rotatable drum therein; a box unit connected to a cover unit having a door thereon, forming an outer wall of the cabinet, and coupled to the rear panel and surrounding the tub; a water supply device supplying wash water into the tub through a top surface of the cabinet; and a drain device discharging wash water from the tub to the bottom of the box unit.

8 Claims, 23 Drawing Sheets

(51) Int. Cl.
*D06F 39/04* (2006.01)
*D06F 39/08* (2006.01)

(52) U.S. Cl.
CPC ..... *D06F 39/083* (2013.01); *D06F 39/088* (2013.01); *D06F 37/263* (2013.01); *D06F 39/12* (2013.01); *Y10T 29/49826* (2015.01)

(58) Field of Classification Search
USPC ... 68/139, 208, 140, 24, 212, 16, 232, 13 R; 34/601, 603, 139, 91, 108, 602, 239, 242; 312/245, 228, 263, 265, 348.2
See application file for complete search history.

(56) References Cited

U.S. PATENT DOCUMENTS 5,421,175 A * 6/1995 Niu ..... D06F 23/02 68/140
5,868,011 A * 2/1999 Hawkins ..... D06F 39/083 137/247.41
2012/0233873 A1 9/2012 Del Pos et al.
2012/0242205 A1 9/2012 Del Pos et al.

FOREIGN PATENT DOCUMENTS

KR 100826174 B1 * 4/2008
WO 2011051176 A1 5/2011
WO 2011051184 A1 5/2011

OTHER PUBLICATIONS

Choo, Sung Youp, "Drum Washing Machine" Dec. 2006, KR 20060125298 Machine Translation.*
Kim, Yeong-Su, "Washing Device" Apr. 2008, KR 100826174 Machine Translation.*
Sung Gon Kim, et al., Korean Patent Abstracts, Abstract of 2003055780000, Feb. 26, 2003, 2 pages, Korea Intellectual Property Rights Information Service, Republic of Korea.
International Search Report dated Mar. 14, 2013, International application No. PCT/KR2012/010513, Korean Intellectual Property Office, Republic of Korea.

* cited by examiner

WALL-MOUNTED DRUM-TYPE WASHING MACHINE

TECHNICAL FIELD

The present invention relates to a wall-mounted drum type washing machine, and more particularly, to a wall-mounted drum type washing machine that has a small size and weight so as to be stably mounted on the wall, that may reduce vibrations and noise, and that includes parts that are easily attached and detached.

BACKGROUND ART

A wall-mounted drum type washing machine may be used in a narrow space, and may be used when it is mounted on the wall.

The wall-mounted drum type washing machine includes a washing machine body and a door which is installed at the front of the washing machine body so as to be opened/closed. The washing machine body forms the exterior of the washing machine, and may be divided into an intermediate case, a rear case, and a front case.

The washing machine body includes a cylindrical tub therein. The tub includes a drum therein that rotates. The drum is rotated by power of a forward/reverse motor inside the washing machine body.

The drum has a pulley on a shaft attached to the drum, and the forward/reverse motor also has a pulley formed on a shaft driven by the motor. The respective pulleys are connected through a power transmission belt to transmit power. The drum has a smaller depth than the diameter thereof. Therefore, the front-to-rear length of the washing machine body may be set to a small value.

The washing machine body has a key input unit on the front surface thereof, that is, the front case. Therefore, when the washing machine body is mounted on the wall or installed at a predetermined height from the bottom surface using a table or the like, a user may easily manipulate the key input unit.

The related art of the present invention is disclosed in Korean Patent Laid-Open Publication No. 10-2006-0125298 published on Dec. 6, 2006 and titled "Drum type washing machine".

DISCLOSURE

Technical Problem

The conventional drum type washing machine includes a tub installed in a cabinet. Therefore, since a separate member is required to support the tub inside the cabinet, it is difficult to reduce the size of the wall-mounted drum type washing machine. Accordingly, the wall-mounted drum type washing machine cannot be installed in certain places.

The conventional wall-mounted drum type washing machine includes a driving unit installed in the cabinet. Therefore, since internal space of the cabinet is occupied by the installation space of the driving unit, there are difficulties in reducing the size of the conventional wall-mounted drum type washing machine.

The conventional wall-mounted drum type washing machine includes a power transmission unit installed between the motor and the drum. Therefore, as the installation space of the power transmission unit occupies space between the motor and the drum, there are difficulties in reducing the size of the conventional wall-mounted drum type washing machine.

In the conventional wall-mounted drum type washing machine, the tub has a cylindrical shape, but the cabinet has a hexahedral shape. Therefore, space remains in the cabinet, it may be difficult to reduce the size of the wall-mounted drum type washing machine, and the wall-mounted drum type washing machine cannot be installed in certain spaces.

The conventional wall-mounted drum type washing machine includes a drain pipe connected to the rear surface of the cabinet so as to drain wash water. Therefore, there are difficulties in installing the conventional wall-mounted drum type washing machine in certain spaces.

The conventional wall-mounted drum type washing machine does not include a heater therein. Therefore, the conventional wall-mounted drum type washing machine cannot perform a hot water washing operation.

The conventional wall-mounted drum type washing machine has a complex sealing structure to cover a gap between the tub and the opening of the cabinet over which the door is installed. Therefore, there may be difficulties in reducing the number of parts and the size of the conventional wall-mounted drum type washing machine.

Thus, there is a demand for a structure capable of solving such problems.

The present invention is conceived to solve such problems of the related art, and an aspect of the invention is to provide a wall-mounted drum type washing machine which has a small size and weight, that is stably mounted on the wall, that may reduce vibrations and noise, and that includes parts that are easily attached and detached.

Another aspect of the invention is to provide a wall-mounted drum type washing machine that may be directly mounted on the wall surface and that reduces a protrusion distance of the front of the washing machine.

Technical Solution

In one embodiment, the wall-mounted drum type washing machine includes a rear panel forming a rear surface of a cabinet, comprising a water supply device that supplies wash water and a driving unit that provides power for a washing operation, mounted on a wall surface; a tub in the cabinet to contain wash water, integrated with the rear panel, and having a rotatable drum therein; a box unit connected to a cover unit having a door thereon, forming an outer wall of the cabinet, and coupled to the rear panel to surround the tub; a water supply device supplying wash water into the tub through a top surface of the cabinet; and a drain device discharging wash water from the tub to a bottom of the box unit.

The wall-mounted drum type washing machine may further include a gasket having one end coupled to the tub and another end attached to the door, that prevents leakage of wash water from a gap between the cabinet and the tub.

The tub may have a mounting hole into which the gasket is inserted and a lock portion that protrudes from an outer circumferential surface of the tub to which the gasket is locked and fixed. The lock portion includes a coupling protrusion that protrudes from the outer circumferential surface of the tub; and a lock protrusion extending from an end of the coupling protrusion in a lateral direction.

The gasket may include a hooked body on the inside of the lock portion and surrounding outer walls of the coupling protrusion and the lock protrusion; a passing body protruding to the outside of the tub through the mounting hole and connected to the hooked body; a coupling body connected to the passing body and attached to the door; and a ring spring in an end of the hooked body, attaching the hooked body to the tub.

The water supply device may have a water supply pipe on a top surface of the rear panel, that supplies wash water to the tub through the rear panel.

The rear panel may have a mounting groove on a rear surface thereof that is concave toward the front side and that forms a space between the wall surface and the rear surface of the rear panel, and the driving unit directly or indirectly connected to the drum through the rear panel is in the mounting groove.

The water supply pipe may be in a connection portion in the top circumference of the mounting groove, and has an upper end protruding from the top surface of the connection portion and a lower end connected to the rear surface of the tub, a water supply valve connected to the water supply pipe is in the connection portion, and a cover is on the connection portion to cover the water supply valve.

The drain device may include a first drain pipe at the bottom of the tub that discharges wash water; a second drain pipe under the first drain pipe and having a larger diameter than the first drain pipe; and a siphon between the first and second drain pipes and connecting the first and second drain pipes that applies a siphon pressure to the first drain pipe by wash water discharged from the second drain pipe.

The siphon may include a body having an introduction port connected to the first drain pipe and a discharge port connected to the second drain pipe; a drain induction member having a cap shape inside the body and having a space at the bottom thereof; and a siphon induction pipe protruding upward from the bottom surface of the body that moves wash water upward and then discharges the wash water through the discharge port and maintains an interval from the drain induction member and forms a flow path.

The rear panel may be fixed to the wall surface using a fastening member that fastens the rear panel to the wall surface through a hole therein.

The wall-mounted drum type washing machine may further include a buffer member between the rear panel and the wall surface that suppresses vibrations generated during a washing process from being transmitted to the wall surface.

Advantageous Effects

In accordance with embodiments of the present invention, since the tub is integral with the rear panel mounted on the wall surface, the wall-mounted drum type washing machine does not require a separate buffer device. Therefore, the size of the drum type washing machine may be reduced, and may be installed in various places.

Furthermore, since the water supply device is on the top surface of the cabinet, the rear surface of the cabinet may be close to the wall surface. Therefore, it is possible to reduce the front protrusion distance of the wall-mounted drum type washing machine.

Furthermore, since the cabinet has a cylindrical shape, a wasted space is not formed between the tub and the cabinet. Therefore, it is possible to reduce the size of the wall-mounted drum type washing machine.

Furthermore, since the driving unit providing power to the drum is outside the cabinet, the wall-mounted drum type washing machine does not require installation of the driving unit inside the cabinet. Therefore, it is possible to reduce the size of the wall-mounted drum type washing machine.

Furthermore, since the driving unit is directly connected to the drum, the wall-mounted drum type washing machine does not require a separate power transmission unit, and it is possible to reduce the number of parts and the size of the wall-mounted drum type washing machine.

Furthermore, since the wash water is discharged from the bottom surface of the cabinet, the drain device does not interfere with the wall surface or another device on the side or bottom surface of the cabinet when the wall-mounted drum type washing machine is installed. Therefore, the wall-mounted drum type washing machine may be installed in various places.

Furthermore, the wall-mounted drum type washing machine includes a heater capable of heating wash water in the tub, and can perform a hot water washing operation. Therefore, it is possible to improve the washing efficiency of the wall-mounted drum type washing machine.

Furthermore, since the gasket between the tub and the cabinet serves as the front panel, it is possible to reduce the number of parts and the size of the wall-mounted drum type washing machine.

Furthermore, since the water supply device and the heater are easily attached and detached, it is possible to reduce the time and cost of replacing or repairing parts of the wall-mounted drum type washing machine.

Furthermore, since the tub of the wall-mounted drum type washing machine has a cylindrical shape, the diameter of which gradually increases toward the door, it is possible to simplify the manufacturing process of the tub. When the drain device is at the front of the tub, wash water remaining in the tub may be easily discharged.

Furthermore, since the driving unit is in the mounting groove in the rear surface of the rear panel, the installation space of the driving unit may be reduced. Therefore, it is possible to effectively reduce the size of the drum type washing machine.

Furthermore, since the rear panel is fixed to the wall surface by the coupling member when the rear panel contacts the wall surface, a separate bracket for fixing the wall-mounted drum type washing machine to the wall is not needed.

Furthermore, since the rear panel is fixed to the wall surface by the coupling member when the buffer member is between the rear panel and the wall surface, it is possible to suppress vibrations of the drum from being transmitted to the wall surface. Accordingly, it is possible to reduce vibrations and noise occurring during washing operations.

BEST MODE

Hereinafter, embodiments of the present invention will be described with reference to accompanying drawings. However, the described embodiments are for illustrative purposes only and are not intended to limit the scope of the invention.

Figure 1:
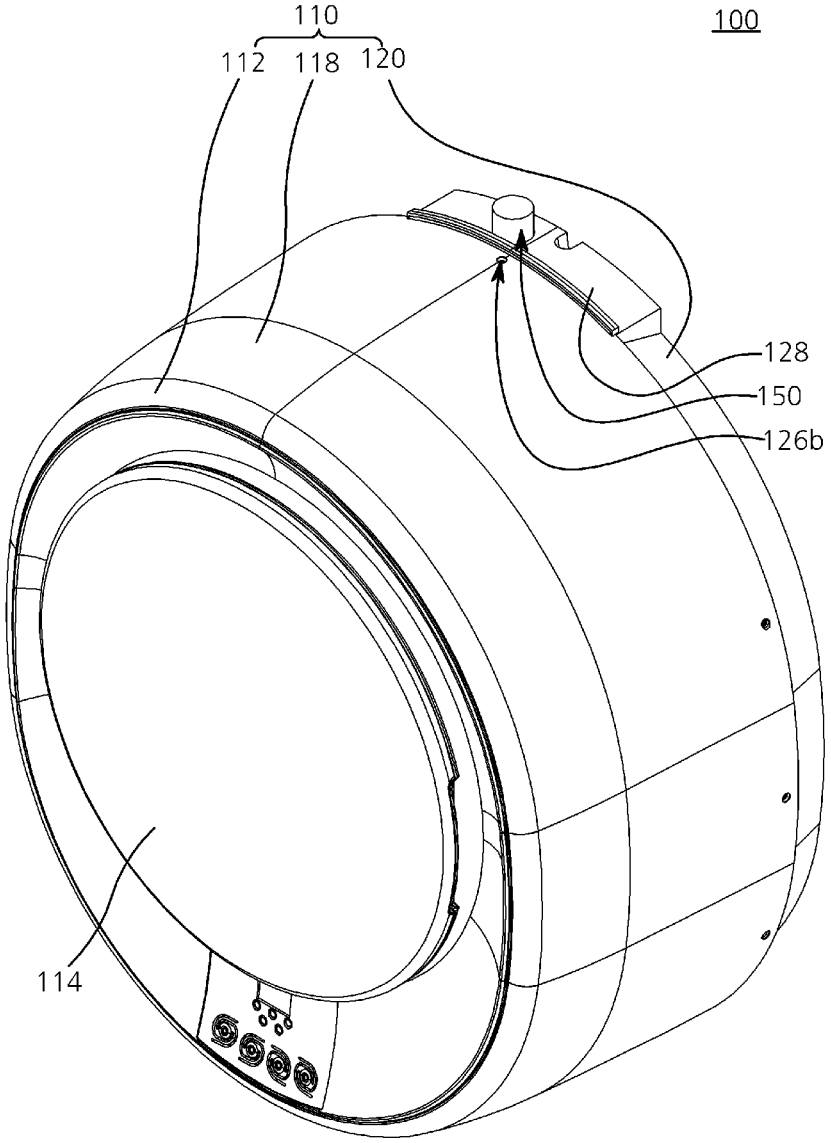
FIG. 1 is a perspective view of a wall-mounted drum type washing machine in accordance with an embodiment of the present invention.
Figure 2:
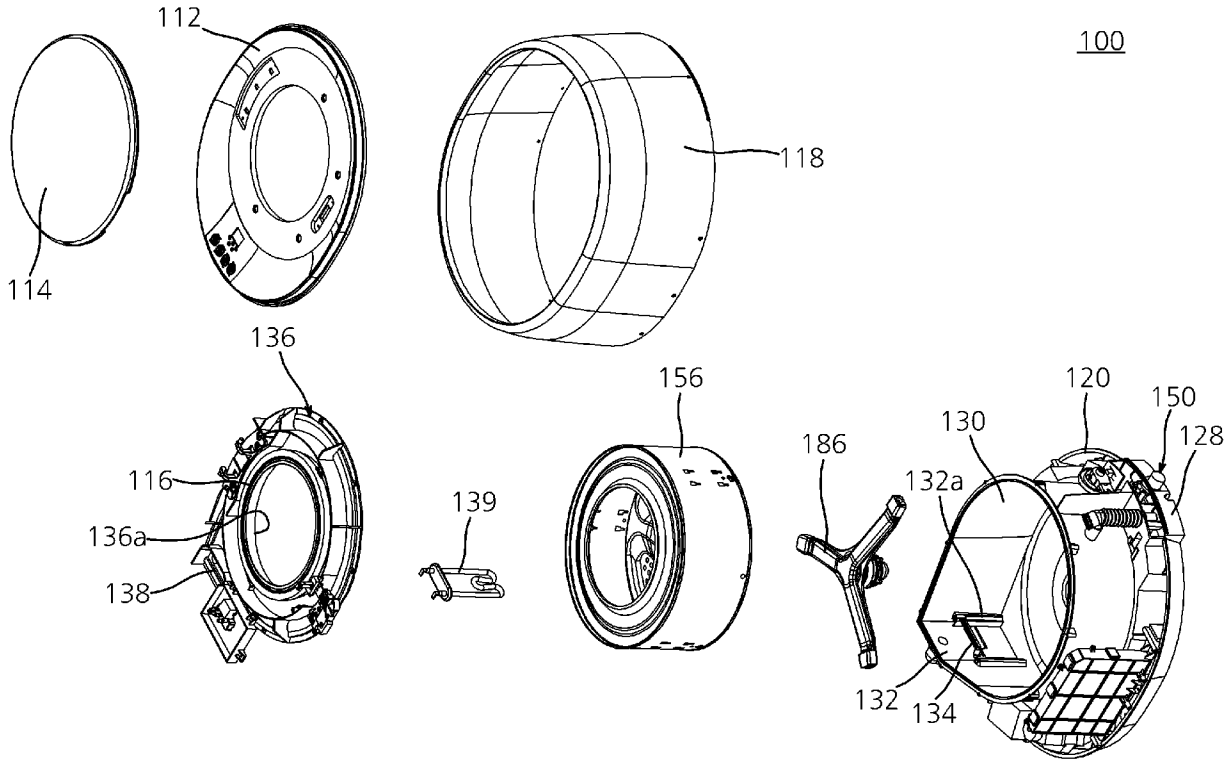
FIG. 2 is an exploded perspective view of components for a wall-mounted drum type washing machine in accordance with an embodiment of the present invention.
Figure 3:
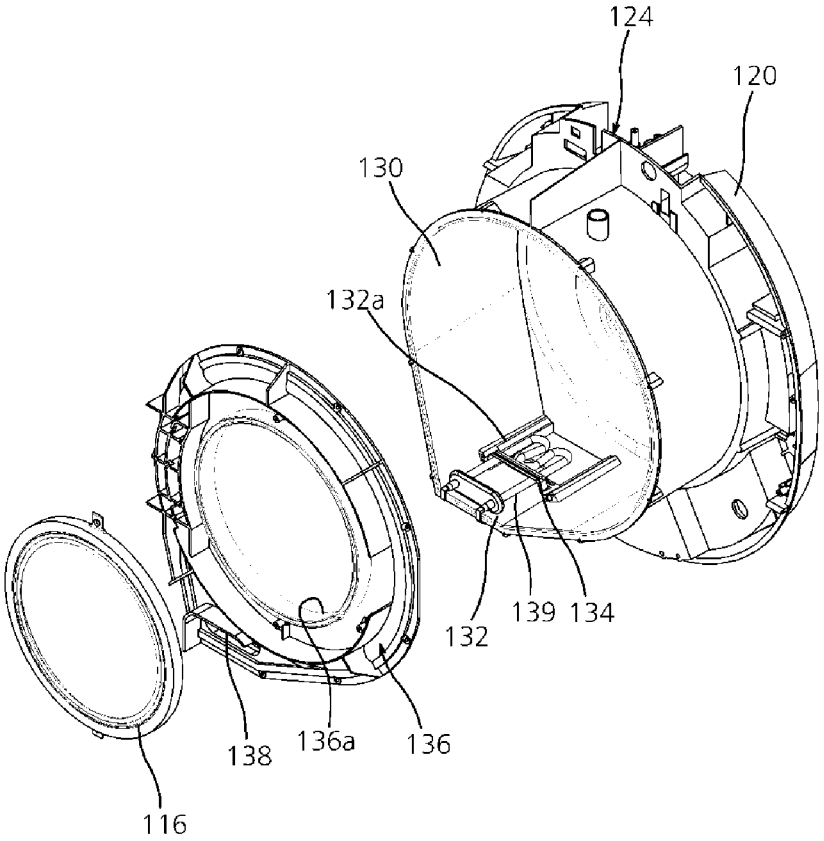
FIG. 3 is an exploded perspective view of a front panel mounting structure for a wall-mounted drum type washing machine in accordance with an embodiment of the present invention.

FIG. 1 is a perspective view of a wall-mounted drum type washing machine in accordance with an embodiment of the present invention. FIG. 2 is an exploded perspective view of the wall-mounted drum type washing machine in accordance with an embodiment of the present invention. FIG. 3 is an exploded perspective view of a front panel mounting structure for a wall-mounted drum type washing machine in accordance with an embodiment of the present invention.

Figure 4:
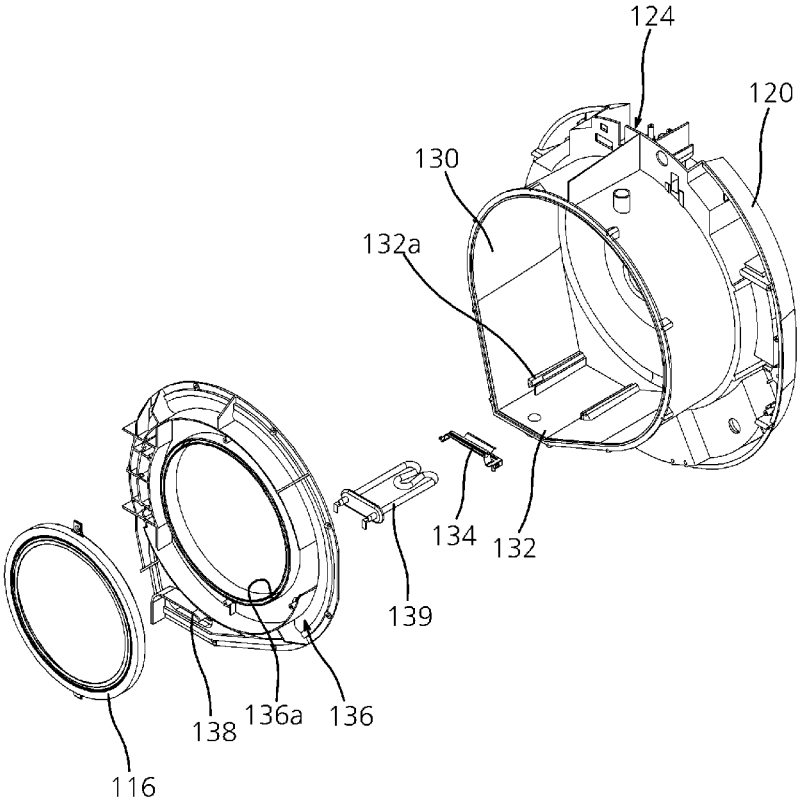
FIG. 4 is an exploded perspective view of a gasket and heater mounting structure for a wall-mounted drum type washing machine in accordance with an embodiment of the present invention.
Figure 5:
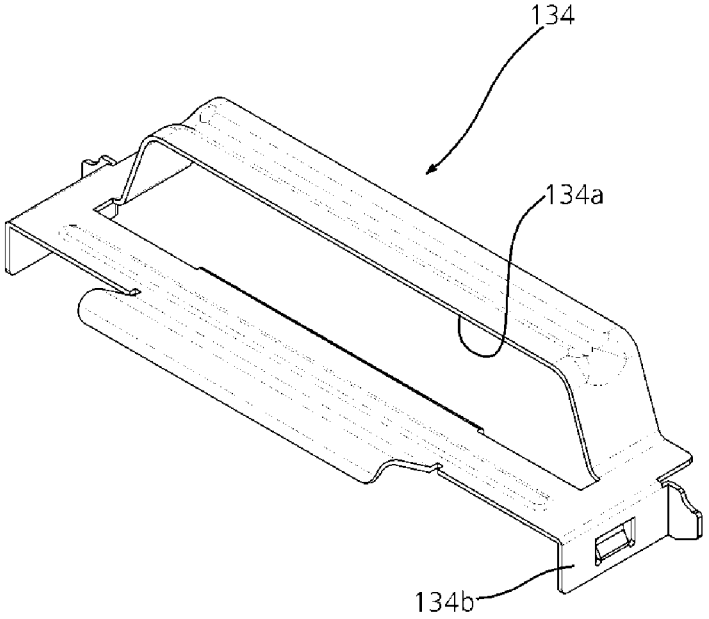
FIG. 5 is a perspective view of a bracket for a wall-mounted drum type washing machine in accordance with an embodiment of the present invention.
Figure 6:
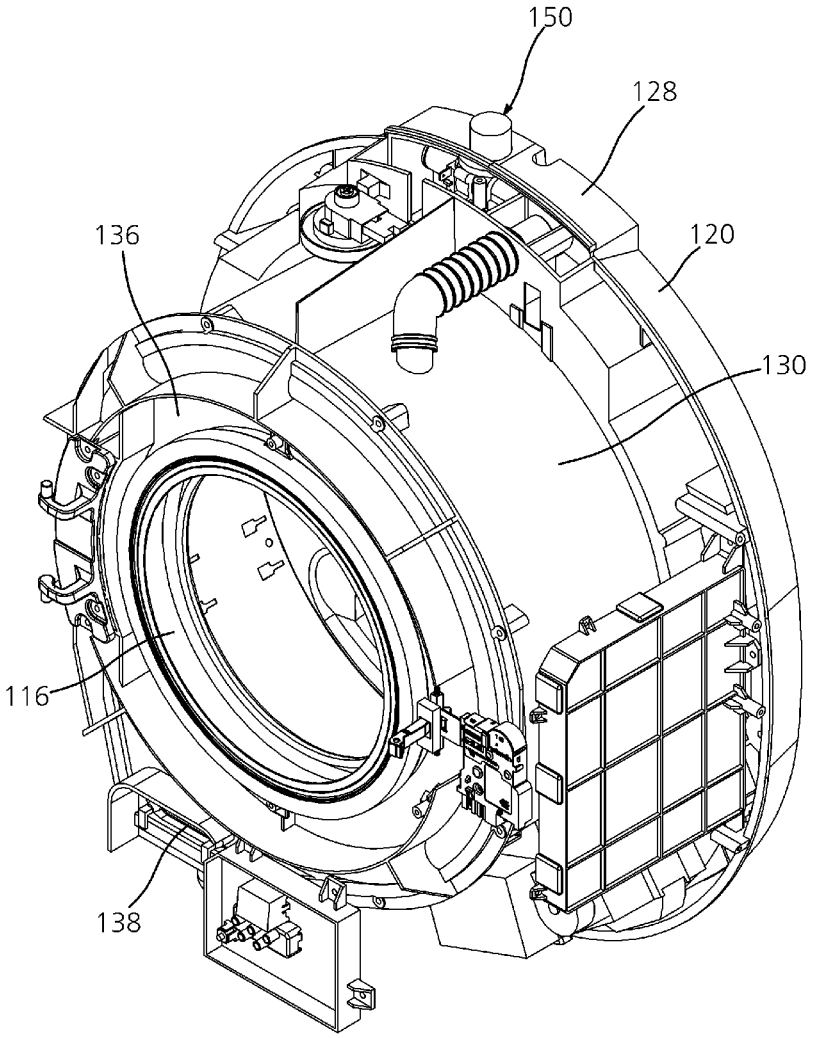
FIG. 6 is a perspective view illustrating a tub, a front panel, and the gasket mounting structure for a wall-mounted drum type washing machine in accordance with an embodiment of the present invention.

FIG. 4 is an exploded perspective view of a gasket and heater mounting structure for a wall-mounted drum type washing machine in accordance with an embodiment of the present invention. FIG. 5 is a perspective view of a bracket for a wall-mounted drum type washing machine in accordance with an embodiment of the present invention. FIG. 6 is a perspective view illustrating a tub, a front panel, and the gasket mounting structure for a wall-mounted drum type washing machine in accordance with an embodiment of the present invention.

Figure 7:
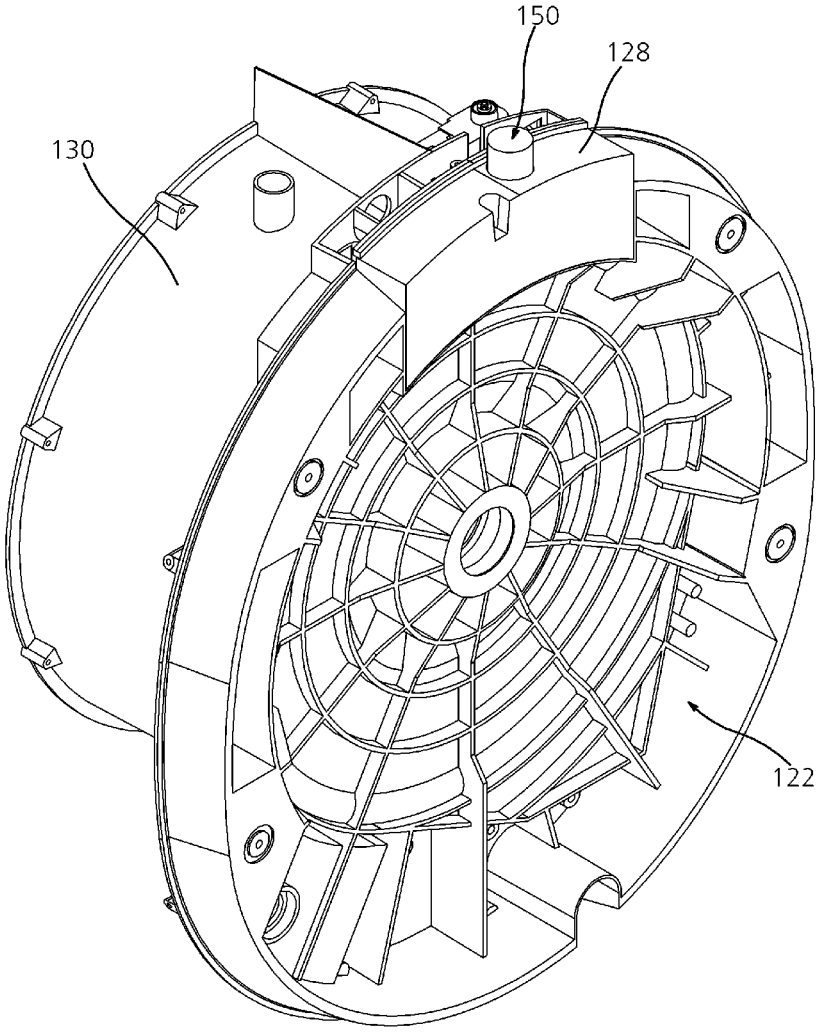
FIG. 7 is a rear perspective view of the tub for a wall-mounted drum type washing machine in accordance with an embodiment of the present invention.
Figure 8:
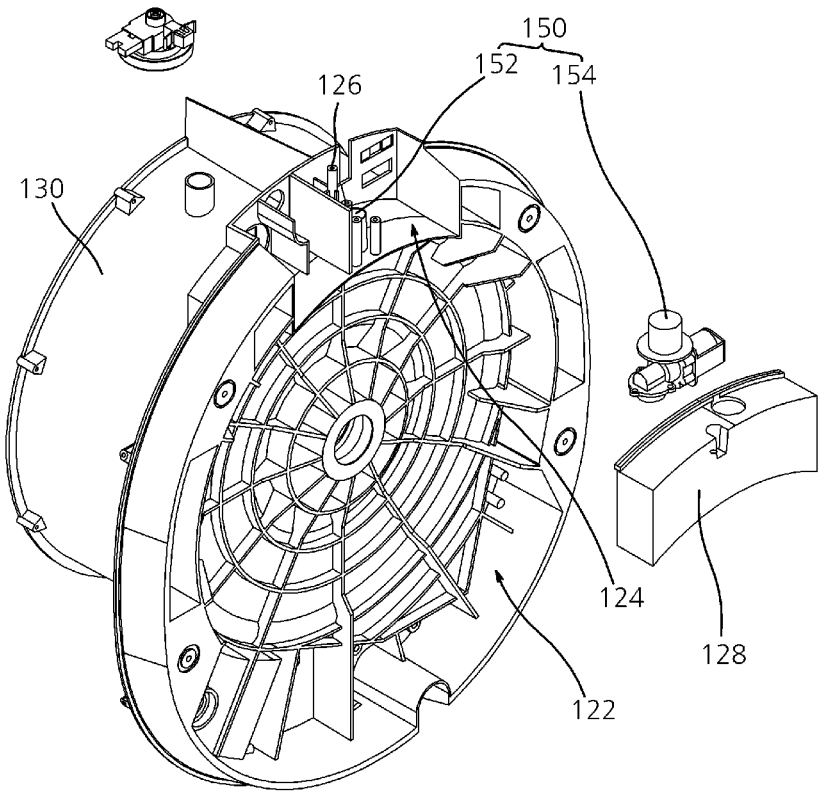
FIG. 8 is an exploded perspective view of a water supply device for a wall-mounted drum type washing machine in accordance with an embodiment of the present invention.
Figure 9:
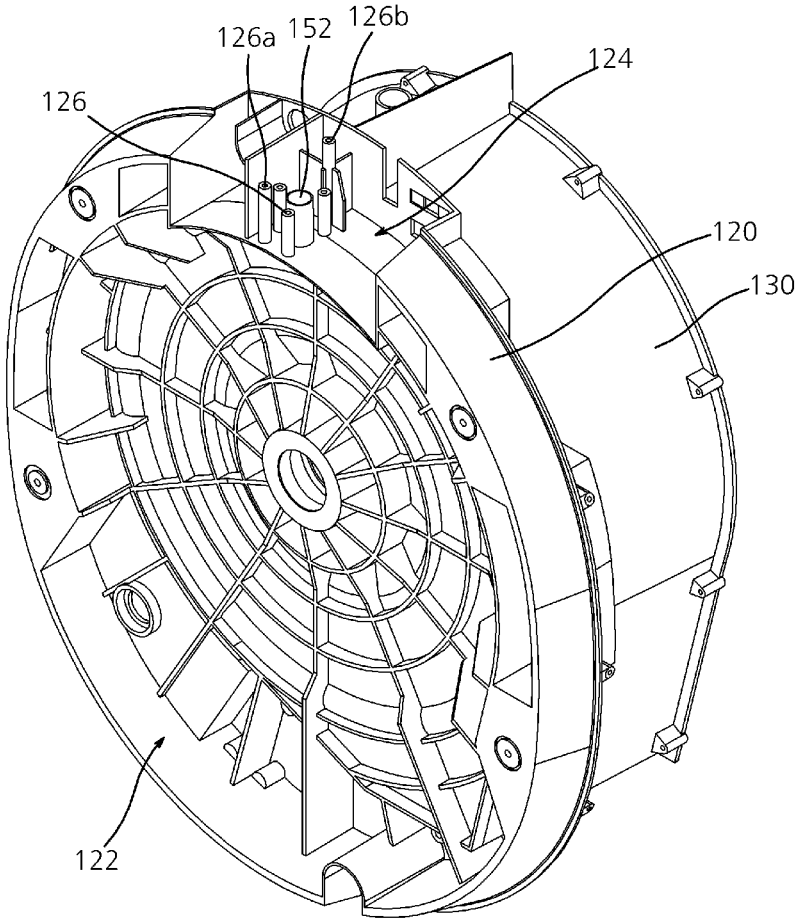
FIG. 9 is a rear perspective view of a connection portion for a wall-mounted drum type washing machine in accordance with an embodiment of the present invention.

FIG. 7 is a rear perspective view of the tub for the wall-mounted drum type washing machine in accordance with an embodiment of the present invention. FIG. 8 is an exploded perspective view of a water supply device for a wall-mounted drum type washing machine in accordance with an embodiment of the present invention. FIG. 9 is a rear perspective view of a connection portion for a wall-mounted drum type washing machine in accordance with an embodiment of the present invention.

Figure 10:
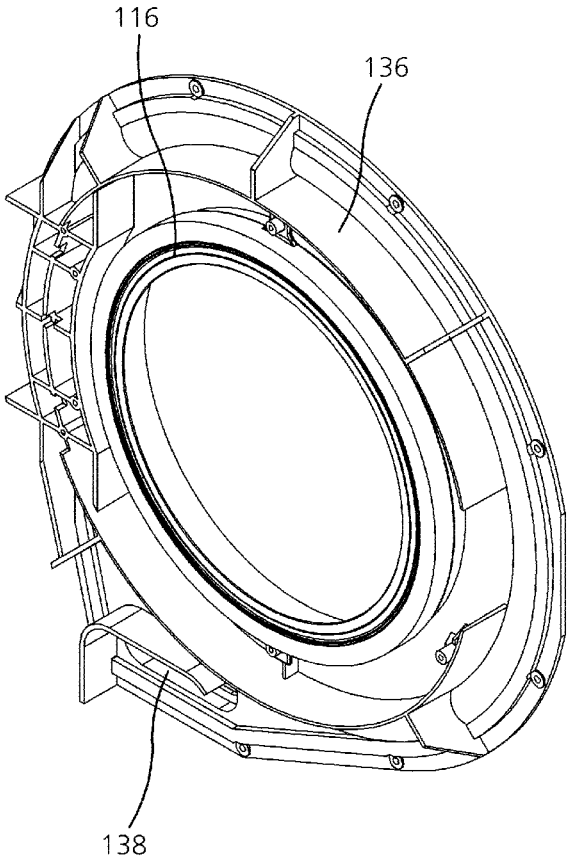
FIG. 10 is a perspective view of the front panel of the wall-mounted drum type washing machine in accordance with an embodiment of the present invention.
Figure 11:
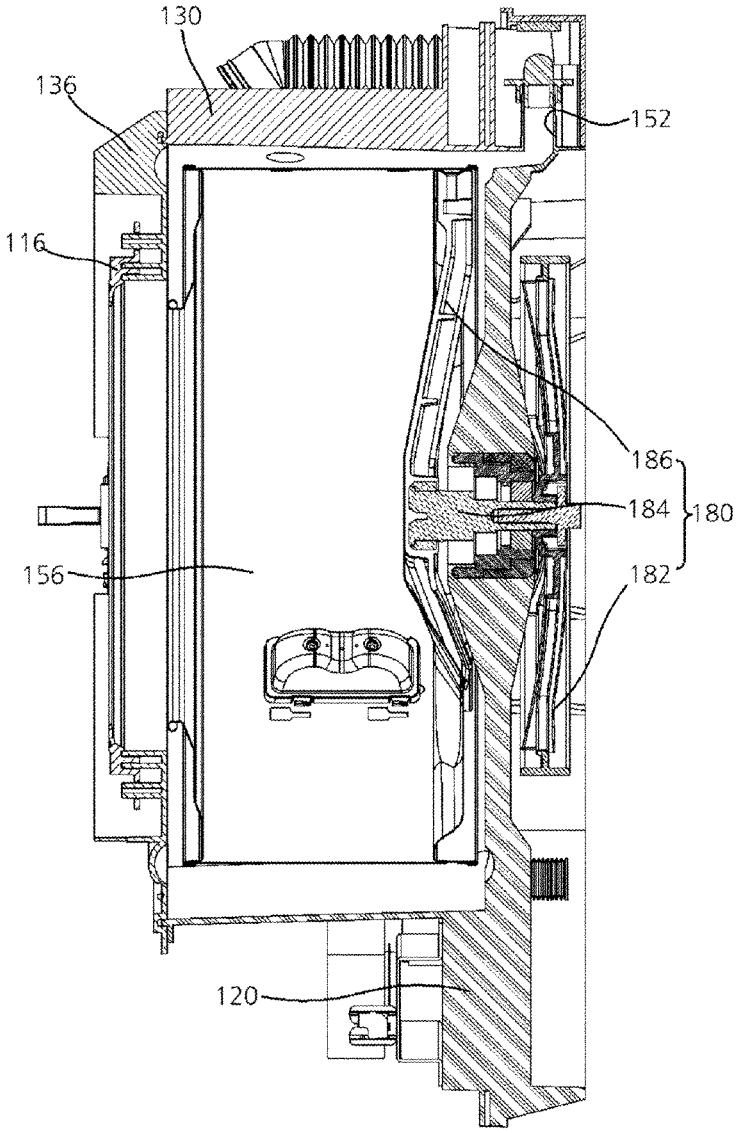
FIG. 11 is a cross-sectional view of the tub, the front panel, and the gasket mounting structure for the wall-mounted drum type washing machine in accordance with an embodiment of the present invention.
Figure 12:
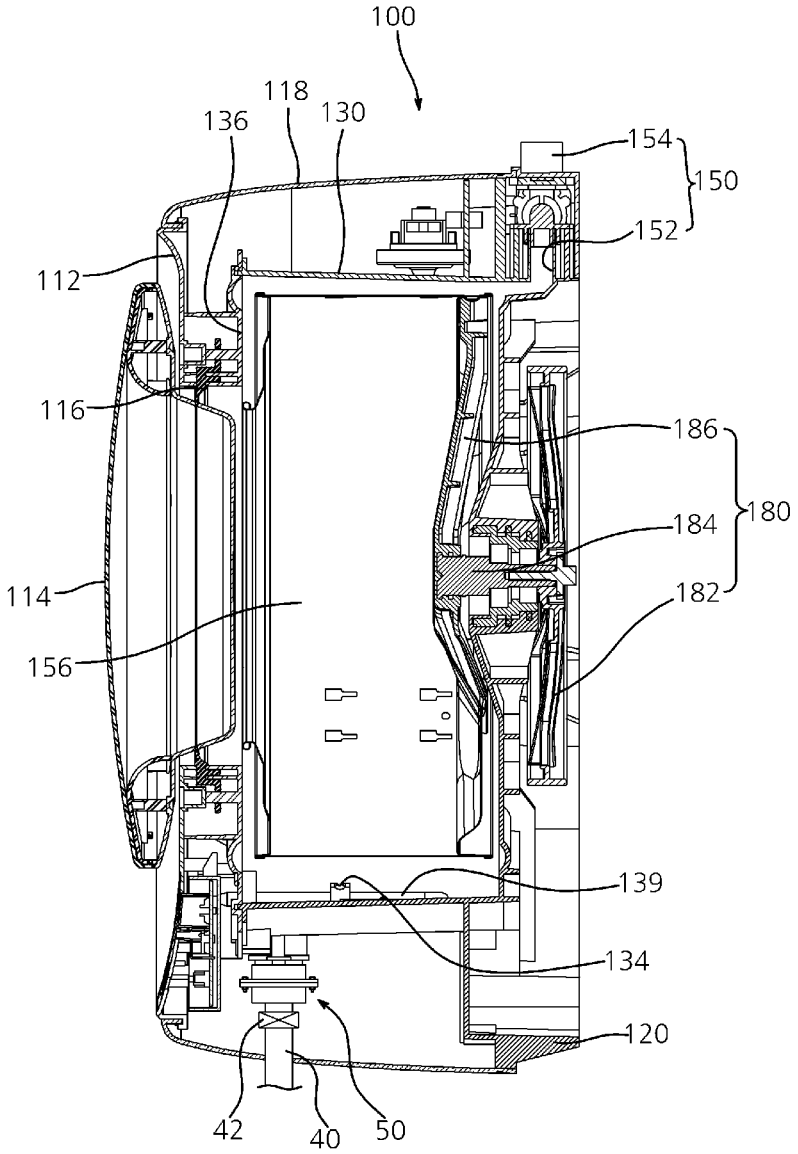
FIG. 12 is a cross-sectional view of the wall-mounted drum type washing machine in accordance with an embodiment of the present invention.

FIG. 10 is a perspective view of the front panel of a wall-mounted drum type washing machine in accordance with an embodiment of the present invention. FIG. 11 is a cross-sectional view of the tub, the front panel, and the gasket mounting structure for the wall-mounted drum type washing machine in accordance with an embodiment of the present invention. FIG. 12 is a cross-sectional view of the wall-mounted drum type washing machine in accordance with an embodiment of the present invention.

Referring to FIGS. 1 to 12, the wall-mounted drum type washing machine in accordance with an embodiment of the present invention includes a cabinet 110, a tub 130, a drum 156, a water supply device 150, and a drain device 30, 40, and 50. The tub 130 is in the cabinet 110 to contain water. The drum 156 is rotatable and is inside the tub 130. The water supply device 150 serves to supply wash water into the tub 130 through a top surface of the cabinet 110. The drain device 30, 40, and 50 serves to discharge the wash water in the tub 130 to the outside.

When a washing operation is started after laundry is put into the drum 156, wash water is supplied to the tub 130 by the water supply device 150.

In accordance with an embodiment of the present invention, the water supply device 150 is at the top surface of the cabinet 110. Therefore, the wash water is supplied to the tub 130 through the top surface of the cabinet 110.

In the conventional wall-mounted drum type washing machine, the water supply device 150 is connected to the rear surface of the cabinet. In this embodiment of the present invention, however, since the water supply device 150 is connected to the top surface of the cabinet 110, the cabinet 110 may be installed so that the rear surface thereof is closely attached to a wall surface W. Accordingly, the wall-mounted drum type washing machine may be easily implemented.

Referring to FIGS. 7 to 9, 11, and 12, the water supply device 150 includes a water supply pipe 152 between an upper or top surface of the cabinet 110 and the rear surface of the tub 130.

The water supply pipe 152 extends upward from the top surface of the cabinet 110. Therefore, when a water supply hose is connected to the water supply pipe 152, wash water is supplied into the cabinet 110 by the water supply pipe 152. The wash water supplied into the cabinet 110 is supplied into the tub 130 through the rear side of the tub 130.

The wash water supplied by the water supply pipe 152 flows onto the outer wall of the drum 156 from the rear side to the front side of the drum 156, and then flows into the drum 156 through a plurality of holes in the wall of the drum 156.

Since the wash water flowing onto the outer wall of the drum 156 washes off foreign matter remaining on the outer wall of the drum 156, it is possible to prevent foreign matter such as detergent or lint from remaining on the outer wall of the drum 156.

Furthermore, since the wash water flowing onto the outer wall of the drum 156 is supplied into the drum 156 through the holes in the wall of the drum 156, the wash water may be uniformly supplied to all of the laundry in the drum 156, which makes it possible to increase wetting efficiency.

Since the wash water is supplied to the drum 156 while flowing from the rear side to the front side of the tub 130, all of the laundry in the drum 156 may be uniformly wetted at the initial stage of the washing operation. Therefore, as the wetting is uniformly performed, it is possible to improve the washing efficiency.

Referring to FIGS. 1 and 2, the cabinet 110 includes a rear panel 120, a box unit 118, and a cover unit 112. The rear panel 120 is mounted on the wall surface W and is integral with the tub 130. The box unit 118 is detachably coupled to the rear panel 120 and surrounds the tub 130. The cover unit 112 is installed in and/or on the box unit 118 and has a door 114 provided thereon.

The rear panel 120 is coupled to the wall surface W using a coupling member 190, and is integral with the tub 130.

Since the rear panel 120 mounted on the wall surface W is integral with the tub 130, a damper or damping spring is not required to support the tub 130, unlike the conventional wall-mounted washing machine. Therefore, the number of parts and the size of the wall-mounted drum type washing machine may be reduced.

Here, the rear panel 120 serves as a support member for supporting the tub 130 and as a mounting member for mounting the cabinet 110 on the wall surface W. Therefore, the structure of the cabinet 110 is simplified, and the support structure of the tub 130 is simplified.

The rear panel 120 has a front side having a circular shape, and the cylindrical tub 130 is integral with the front surface of the rear panel 120. The front shape of the rear panel 120 may be replaced with another shape, instead of a circular shape.

The tub 130 has a cylindrical shape, of which the diameter gradually increases toward the door 114. Accordingly, the wash water supplied into the tub 130 flows toward the front side of the tub 130 from the rear side of the tub 130.

Referring to FIG. 12, when a siphon drain unit 50 is connected to the front portion of the tub 130, the wash water remaining in the tub 130 flows toward the front side of the tub 130 along an inclined surface on the inner wall of the tub 130. Then, since the wash water at the front of the tub 130 is discharged to the outside through the siphon drain unit 50, it is possible to prevent the wash water from remaining in the tub 130.

The box unit 118 has a cylindrical shape, of which front and rear surfaces are opened. The box unit 118 has a larger diameter than the tub 130, to surround the circumferential surface of the tub 130. The rear end portion of the box unit 118 is detachably coupled to the rear panel 120 using a screw or the like. That is, the tub 130 is surrounded by the box unit 118 when the box unit 118 is coupled to the rear panel 120.

The cover unit 112 is installed at the front opening of the box unit 118. The cover unit 112 has a circular panel shape, that is, a circular plane shape, and includes an opening in the central portion thereof. The opening is opened and/or closed by the door 114 attached to the cover unit 112.

The tub 130 includes a front panel 136 having a housing hole 136*a* therein, and the box unit 118 is coupled to the rear panel 120 and surrounds the tub 130. The cover unit 112 is at the front side of the box unit 118 and covers the front panel 136.

As such, the front panel 136 is surrounded by the cover unit 112. The cover unit 112 is reliably fixed and elastically coupled to the box unit 118, and the box unit 118 is coupled to the rear panel 120 mounted on the wall surface W using a coupling member or the like. Therefore, it is possible to support the tub 130 while reducing vibrations of the front portion of the tub 130, without a damper or damping spring to support the front portion of the tub 130.

As described above, since the wall-mounted drum type washing machine is not on the ground, but rather, mounted on the wall, the exterior shape of the wall-mounted drum type washing machine is not limited to a hexahedral shape, but may be changed to various shapes. In this embodiment of the present invention, a case in which the cabinet 110 forming a circular exterior shape of the wall-mounted drum type washing machine is taken as an example.

Figure 18:
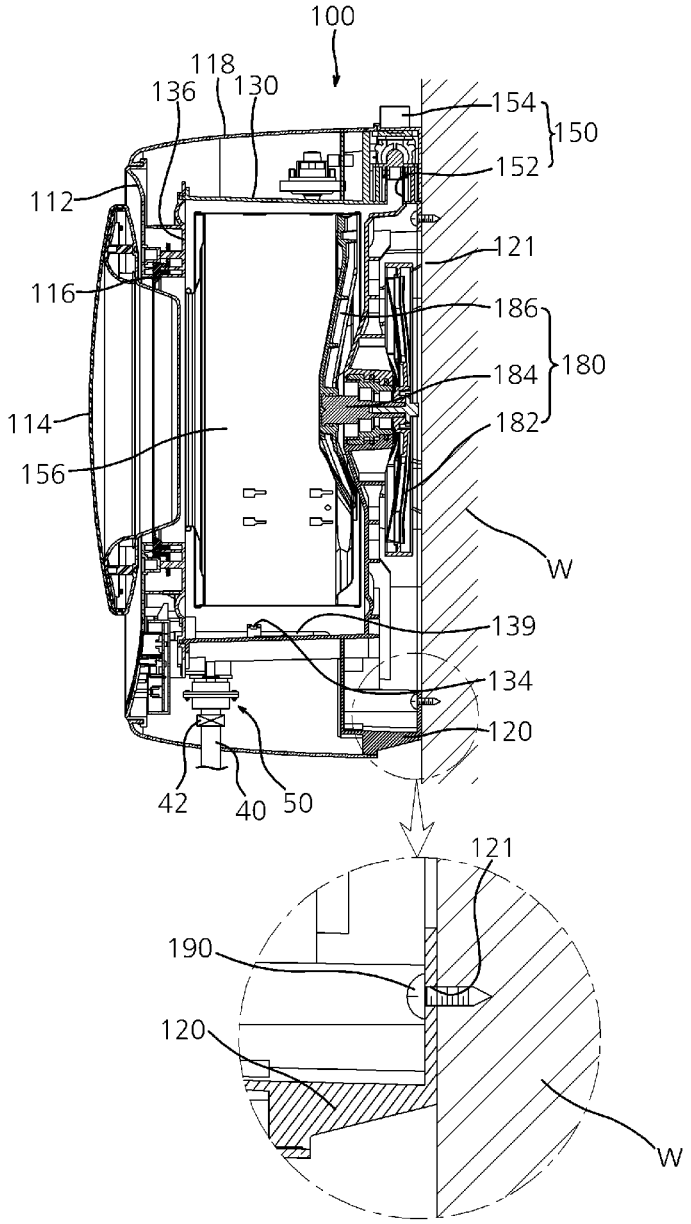
FIG. 18 is a diagram illustrating an example in which a wall-mounted drum type washing machine in accordance with an embodiment of the present invention is installed on the wall surface.

Referring to FIGS. 3, 6, and 18, the tub 130 is formed integrally with the rear panel 120 by insert injection molding or the like. Furthermore, the rear panel 120 is reliably mounted on the wall surface W using a coupling member 190. Since the tub 130 is integral with the rear panel 120, which is directly coupled and fixed to the wall surface W, a damper or damping spring for damping vibrations may be omitted.

Furthermore, since the drum 156 in accordance with an embodiment of the present invention is manufactured with a small capacity to house and wash only a small amount of laundry, vibrations generated by the rotation of the drum 156 may be sufficiently offset by the coupling force between the rear panel 120 and the wall W through the coupling member(s) 190.

Accordingly, it is possible to not only suppress vibrations and noise occurring during the washing operation of the wall-mounted drum type washing machine, but also to omit a damper or damping spring that reduces vibrations and noise in the conventional wall-mounted drum type washing machine. Therefore, the weight of the wall-mounted drum type washing machine may be reduced.

Referring to FIGS. 7 and 8, the rear panel 120 has a mounting groove 122 that forms a space between the wall surface W and the rear panel 120. The mounting groove 122 is concave toward the front side from the rear-side circumference of the rear panel 120.

Accordingly, a driving unit 180 may be located in the space in the mounting groove 122 between the wall surface W and the rear surface of the rear panel 120. Therefore, since a separate space for the driving unit 180 is not absolutely necessary, the distance of the front of the wall-mounted drum type washing machine from the wall surface W may be reduced. As a result, it is possible to reduce the size of the wall-mounted drum type washing machine.

Referring to FIG. 9, the water supply pipe 152 protrudes upward from the top surface of the cabinet 110. Specifically, the water supply pipe 152 is in a connection portion 124 in a partitioned portion of the mounting groove 122. The water supply pipe 152 on the top surface of the rear panel 120 does not interfere with the box unit 118.

Therefore, when the water supply device 150 is to be replaced or repaired, the water supply device 150 may be replaced or repaired when the box unit 118 is in place on the rear panel 120.

Referring to FIGS. 8 and 12, a water supply valve 154 is in the connection portion 124 and connected to the water supply pipe 152, and a cover 128 is detachably mounted on the connection portion 124 to cover the water supply pipe 152 and the water supply valve 154. Accordingly, when the cover 128 is separated from the connection portion 124, the operation of replacing or repairing the water supply pipe 152 or the water supply valve 154 may be immediately performed.

In addition to the water supply pipe 152, a plurality of coupling holes 126 having a pillar shape are on the top surface of the rear panel 120. A part of the coupling holes 126 fix the water supply valve 154 to the connection portion 124 using a screw or the like.

The cover 128 is coupled to any one coupling hole 126*b* of the coupling holes 126 using a screw or the like. The box unit 118 is reliably coupled to the rear panel 120 using any one coupling hole 126*b* of the coupling holes 126 using a screw or the like.

When the screw or the like in the coupling hole 126 is removed, the cover 128 may be separated or removed from the connection portion 124. Furthermore, the water supply valve 154 exposed to the outside by removing the cover 128 may be easily removed from the water supply pipe 152.

When the water supply valve 154 is broken, the water supply valve 154 may be immediately replaced by removing the cover 128 from the connection portion 124 when the box unit 118 is in place on the rear panel 120.

The rear panel 120 and the tub 130 comprise a synthetic resin material. Furthermore, since the rear panel 120 and the tub 130 are manufactured by insert injection molding, the tub 130 and the rear panel 120 may be simultaneously manufactured by one injection molding operation, and the tub 130 and the rear panel 120 are integrated by injection molding. Accordingly, it is possible to reduce the time and cost for manufacturing the tub 130 and the rear panel 120.

Referring to FIGS. 2, 7 and 12, the driving unit 180 to provide power to the drum 156 is at the rear side of the rear panel 120.

The driving unit 180 includes a motor 182, a rotating shaft 184, and a support 186. The motor 182 is at the rear side of the rear panel 120, or specifically, in the mounting groove 122. The rotating shaft 184 transmits power from the motor 182, and extends through the real panel 120. The support 186 connects the rotating shaft 184 and the drum 156.

The support 186 has a tripod shape and is attached to the outer wall of the rear surface of the drum 156. The rotating shaft 184 is coupled to the center of the support 186, and the power of the motor 182 is transmitted to the drum 156 through the rotating shaft 184 and the support 186.

Referring to FIGS. 3 to 5, the tub 130 includes a receiving groove 132 having a heater 139 thereon, and a slidable bracket 134 to support the heater 139 is coupled to the receiving groove 132.

The concave receiving groove 132 is formed on a bottom of the tub 130 in a side direction. The receiving groove 132 includes a pair of rails 132*a* therein such that the bracket 134 is slidably inserted.

The bracket 134 includes a pair of protrusions 134*b* and an insertion hole 134*a*. The pair of protrusions 134*b* slide along the rails 132*a*. The insertion hole 134*a* is between the pair of protrusions 134*b*, and one end portion of the heater 139 is inserted into the insertion hole 134*a*.

Referring to FIGS. 2 to 4, the front panel 136 is at the front of the tub 130, and has a connection hole 138 therein to support the heater 139. Therefore, when the heater 139 is inserted through the connection hole portion 138 when the front panel 136 is on or over the tub 130, one end portion of the heater 139 is supported by the insertion hole 134*a*, while another end portion of the heater 139 is supported by the connection hole portion 138.

Accordingly, when the heater 139 needs to be repaired or replaced, an operator may immediately remove the heater 139 through the connection hole portion 138, without removing the front panel 136 from the tub 130.

The cover unit 112 having the door 114 thereon is on the box unit 118, and the gasket 116 is in the housing hole 136*a* of the front panel 136 facing the door 114.

Figure 13:
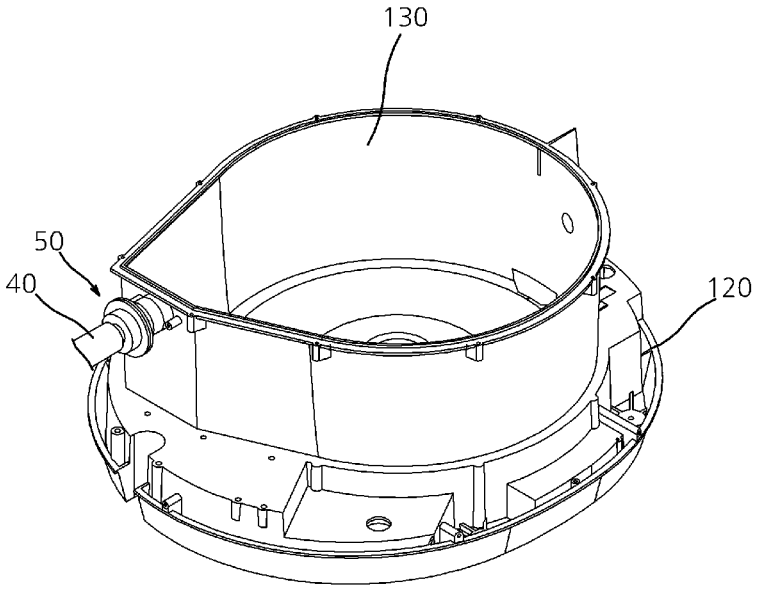
FIG. 13 is a perspective view of a drain device mounting structure for a wall-mounted drum type washing machine in accordance with an embodiment of the present invention.
Figure 14:
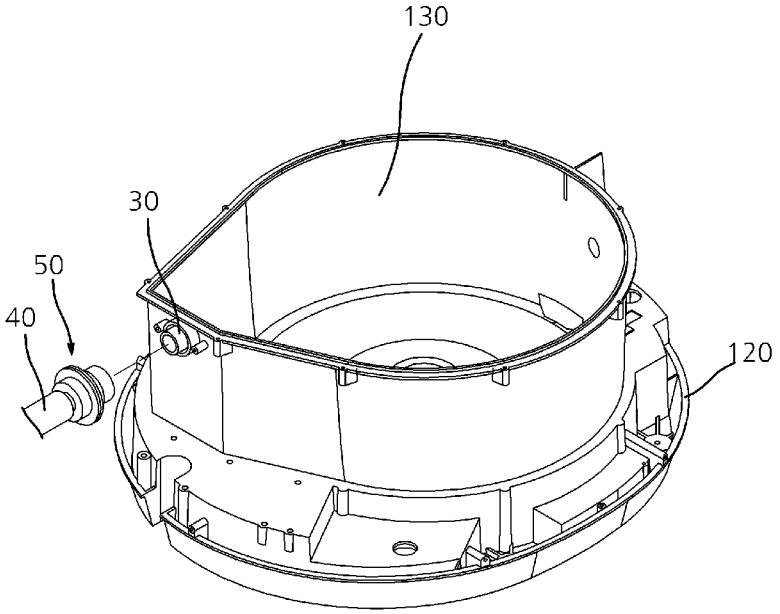
FIG. 14 is an exploded perspective view of the drain device mounting structure for the wall-mounted drum type washing machine in accordance with an embodiment of the present invention.
Figure 15:
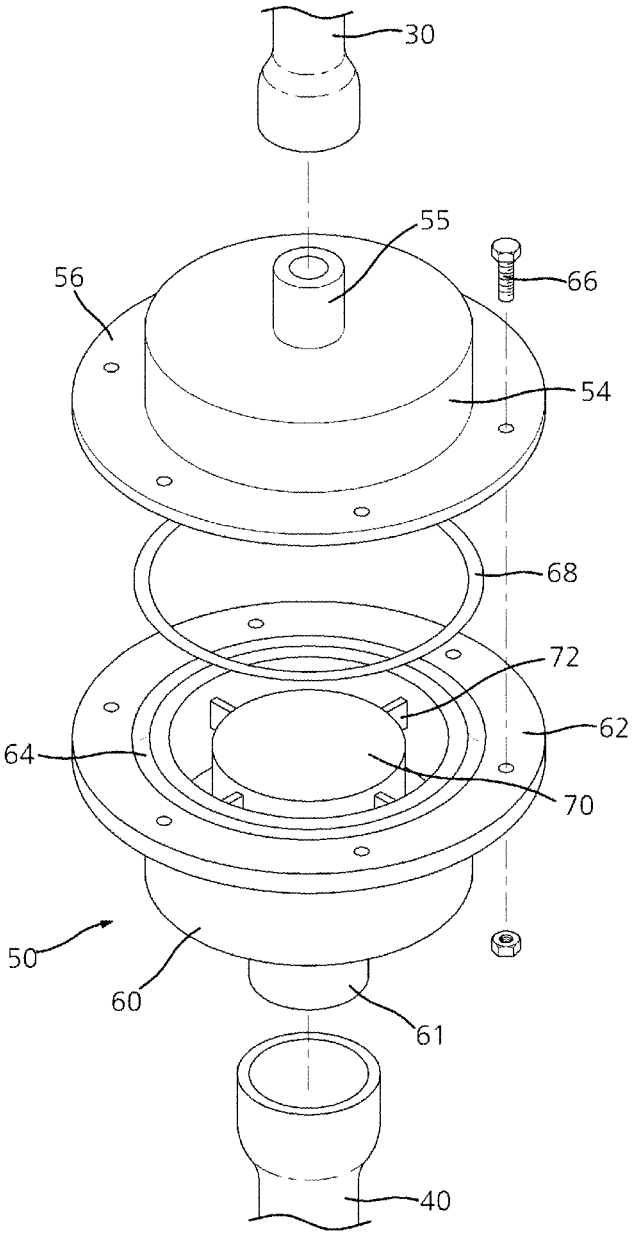
FIG. 15 is an exploded perspective view of the drain device for a wall-mounted drum type washing machine in accordance with an embodiment of the present invention.

FIG. 13 is a perspective view of a drain device mounting structure for a wall-mounted drum type washing machine in accordance with an embodiment of the present invention. FIG. 14 is an exploded perspective view of the drain device mounting structure of the wall-mounted drum type washing machine in accordance with an of the present invention. FIG. 15 is an exploded perspective view of the drain device for a wall-mounted drum type washing machine in accordance with an embodiment of the present invention.

Figure 16:
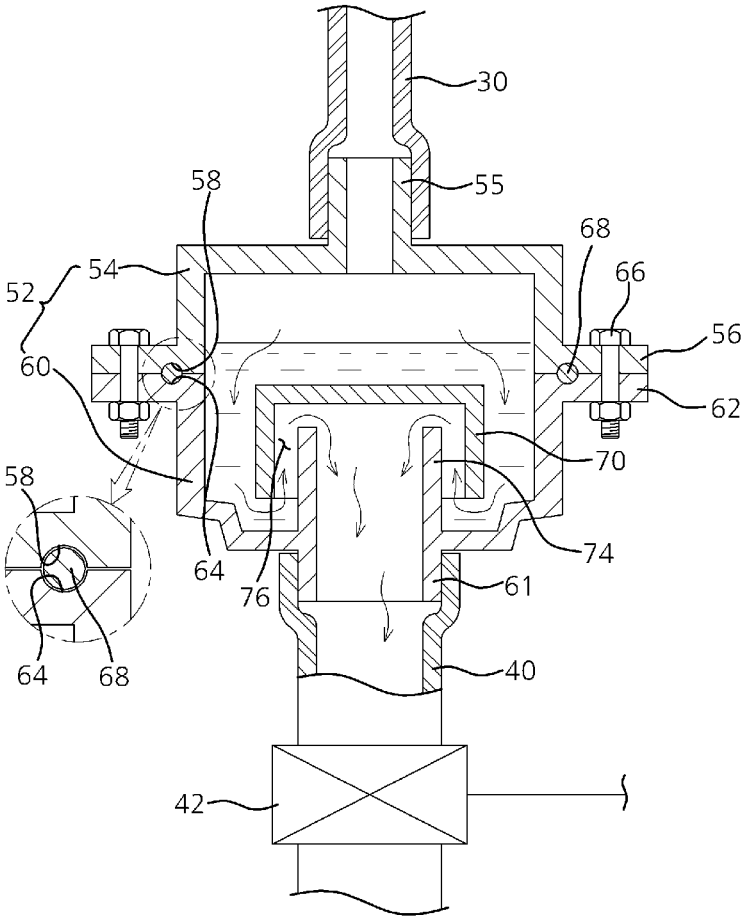
FIG. 16 is a side cross-sectional view illustrating an assembled drain device for a wall-mounted drum type washing machine in accordance with an embodiment of the present invention.
Figure 17:
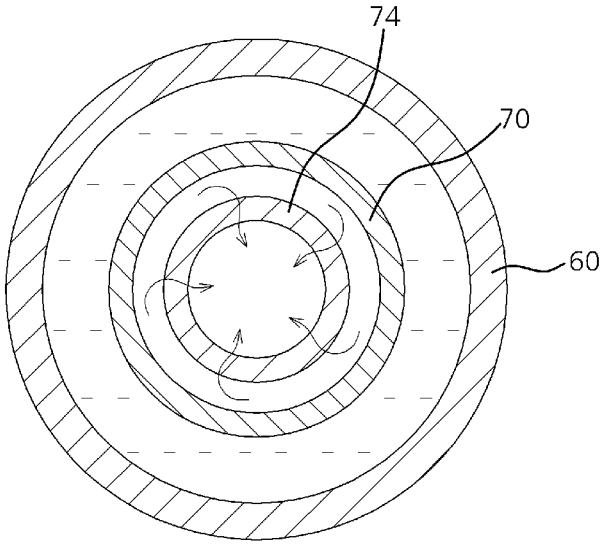
FIG. 17 is a cross-sectional plan view of the drain device in accordance with an embodiment of the present invention.

FIG. 16 is a side cross-sectional view illustrating a state in which the assembled drain device of the wall-mounted drum type washing machine in accordance with an embodiment of the present invention. FIG. 17 is a plan cross-sectional view of the drain device in accordance with an embodiment of the present invention.

Referring to FIGS. 13 to 17, the drain device 30, 40, and 50 is at the bottom of the tub 130 and discharges wash water collected at the bottom of the drum 156. The drain device 30, 40, and 50 in accordance with an embodiment of the present invention includes a first drain pipe 30, a second drain pipe 40, and a siphon drain unit 50.

The first drain pipe 30 is at the bottom of the tub 130. The wash water supplied to the drum 156 is discharged to the outside of the cabinet 110 through the first drain pipe 30 after the washing operation is performed.

The second drain pipe 40 is under the first drain pipe 30, and has a larger diameter than the first drain pipe 30. The second drain pipe 40 is connected to the first drain pipe 30 through the siphon drain unit 50.

The second drain pipe 40 includes a drain valve 42 to control the discharged amount of wash water. The drain valve 42 may include a solenoid valve. The first and second drain pipes 30 and 40 are arranged in such a manner that the central lines thereof vertically coincide with each other.

The siphon drain unit 50 is between the first and second drain pipes 30 and 40. The siphon drain unit 50 applies siphon pressure to the first drain pipe 30 using wash water in the second drain pipe 40, thereby promoting the discharge of the wash water.

The siphon drain unit 50 includes a body 52, a drain induction member 70, and a siphon induction pipe 74.

The body 52 includes an inlet 55 connected to the first drain pipe 30 and an outlet 61 connected to the second drain pipe 40, and has an internal space to store wash water.

Specifically, the body 52 is divided into a first body 54, a second body 60, and a fixing member 66. The first body 54 includes the inlet 55 and a first flange 56 on the lower circumference thereof. The second body 60 includes the outlet 61 and a second flange 62 contacting the first flange 56. The fixing member(s) 66 couples the first and second flanges 56 and 62.

Furthermore, an O-ring 68 for sealing may be provided on corresponding inner surfaces of the first and second flanges 56 and 62. The O-ring 68 may have a circular or polygonal cross-section. In this embodiment of the present invention, the O-ring 68 has a circular cross-section.

The O-ring 68 is in a first receiving groove 58 in the first flange 56 and a second receiving groove 64 in the second flange 62. The first and second receiving grooves 58 and 64 face each other.

The fixing member 66 includes a bolt inserted into holes in the first and second flanges 56 and 62, respectively, and a nut coupled to the bolt. If necessary, another fixing member such as a screw may be used.

The drain induction member 70 having a cap shape is in the body 52, and has a space therein. The drain induction member 70 is supported by a plurality of support members 72 between an inner surface of the body 52 and an outer surface of the drain induction member 70.

The drain induction member 70 has a lower circumferential surface thereof that is a predetermined distance from the bottom surface of the second body 60. This structure may be implemented by connecting the outer surface of the drain induction member 70 and the inner surface of the second body 52 through the support members 72.

The siphon induction pipe 74 is fixed to the body 52 such that wash water rises and is then discharged through the outlet 61. The siphon induction pipe 74 is configured in a manner in which the inner wall of the drain induction member 70 is separated from the outer wall of the siphon induction pipe 74, and the wash water rises through a flow path 76 in the space between the inner wall of the drain induction member 70 and the outer wall of the siphon induction pipe 74.

The siphon induction pipe 74 extends upward from the bottom surface of the body 52 and is connected to the outlet 61, and has an inner diameter equal to that of the outlet 61. The outlet 61 has an inner diameter equal to that of the second drain pipe 40.

The drain induction member 70 surrounds the upper portion of the siphon induction pipe 74 protruding upward from the bottom of the body 52, and the gap between the inner wall of the drain induction member 70 and the outer wall of the siphon induction member 74 serves as the flow path 76.

Therefore, wash water introduced into the body 52 through the first drain pipe 30 strikes the drain induction member 70 and then moves toward the outer edge of the drain induction member 70 (that is, the inner wall of the body 52). Then, the wash water drops toward the bottom of the body 52, rises along the flow path 76 between the drain induction member 70 and the siphon induction pipe 74, and then flows through the outlet 61 via the siphon induction pipe 74.

Since the drain process is delayed while the wash water flows along the above-described path, siphon pressure is applied to the first drain pipe 30.

Figure 19:
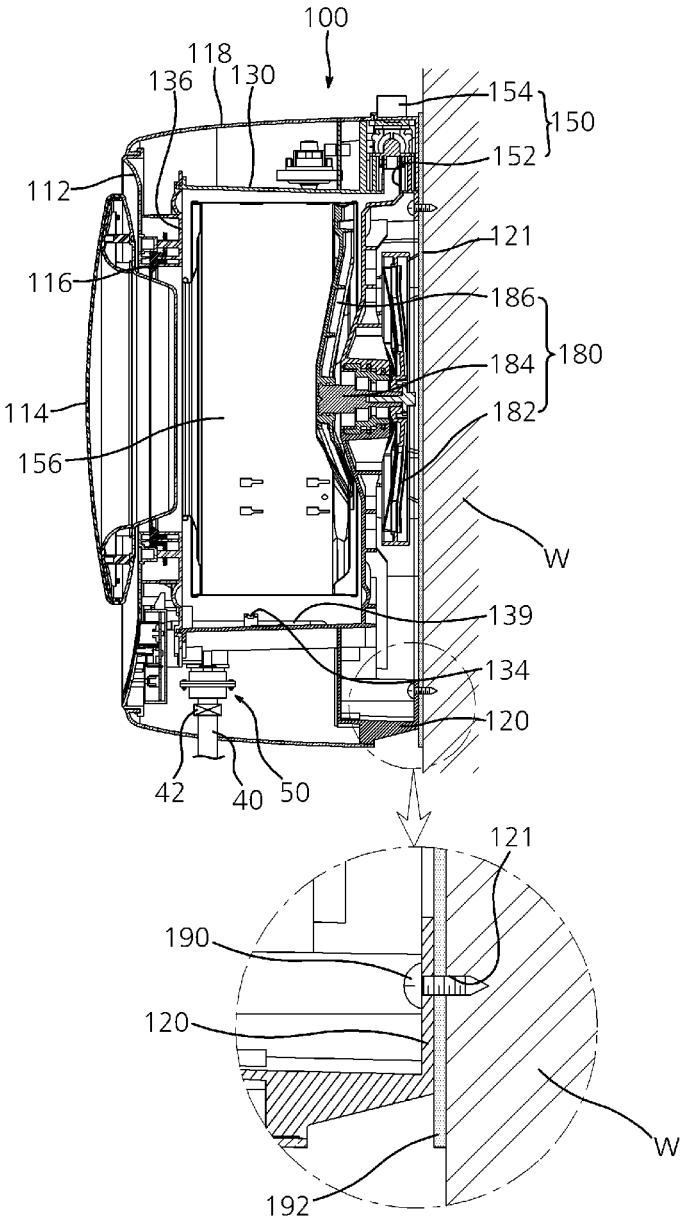
FIG. 19 is a diagram illustrating a modified example in which the wall-mounted drum type washing machine in accordance with an embodiment of the present invention is installed on the wall surface.

FIG. 18 is a diagram illustrating an example in which the wall-mounted drum type washing machine in accordance with an embodiment of the present invention is installed on the wall surface. FIG. 19 is a diagram illustrating a modified example in which the wall-mounted drum type washing machine in accordance with an embodiment of the present invention is installed on the wall surface.

Referring to FIG. 18, the rear panel 120 is installed on the wall surface W using a plurality of coupling members 190. Specifically, when the rear panel 120 is attached to the wall surface W, a planar surface at the edge of the rear surface thereof.

When the rear panel 120 is attached to the wall surface W, the coupling member 190 is coupled to the wall surface W through a hole 121 in the rear panel 120.

Accordingly, the rear panel 120 may be reliably fixed to the wall surface W. Therefore, even when an external force is applied to the wall-mounted drum type washing machine, it is possible to prevent the wall-mounted drum type washing machine from falling down. Furthermore, since a separate bracket for fixing the wall-mounted drum type washing machine to the wall is not needed, the number of parts and weight of the wall-mounted drum type washing machine may be reduced.

Referring to FIG. 19, an additional buffer member 192 may be additionally disposed between the rear panel 120 and the wall surface W. Since the rear panel 120 and the wall surface W are not in direct contact with each other because of the buffer member 192, it is possible to prevent vibrations of the drum 156 from being transmitted to the wall surface W through the rear panel 120 during the operation of the wall-mounted drum type washing machine. Accordingly, it is possible to reduce vibration and noise occurring during the washing operation of the wall-mounted drum type washing machine.

The operation of the wall-mounted drum type washing machine in accordance with an embodiment of the present invention will be described as follows.

When a user puts laundry into the drum 156 and then starts a washing operation, wash water is supplied into the tub 130 through the water supply pipe 152 by the operation of the water supply valve 154.

At this time, the wash water supplied along the water supply pipe 152 on the top surface of the cabinet 110 is supplied to the tub 130 through the rear panel 120. Specifically, the wash water is supplied to the tub 130 through the concave mounting groove 122 in the rear panel 120 (refer to FIGS. 11 and 12).

While the wash water flows the water supply pipe 152 and passes through the rear panel 120, the wash water flows to the rear side of the tub 130. Then, the wash water is supplied to the front side from the rear side of the tub 130.

Therefore, since the wash water supplied from the rear surface of the tub 130 is supplied to both of the rear surface and the circumferential surface of the drum 156, the wash water may wash foreign matters remaining on the inner wall of the tub 130 and the outer wall of the drum 156.

When the supply of the wash water is completed, power is applied to the motor 182 to rotate the drum 156 via the rotating shaft 184 and the support 186. Then, a wash operation is performed. When the wash operation is completed after a preset time, the drum 156 is stopped, and the drain valve 42 in the second drain pipe 40 is opened to discharge the wash water.

At this time, the body 52 and the second drain pipe 40 already store wash water, before the drain valve 42 is opened. As the wash water is discharged to the second drain pipe 40 at the same time as the drain valve 42 is opened, a negative pressure is generated to pull the wash water in the body 52 through the outlet 61, the siphon induction pipe 74, and the flow path 76.

That is, as the negative pressure is generated in the body 52, siphon pressure is applied to the wash water flowing to the first drain pipe 30 having a smaller diameter than the diameter of the second drain pipe 40, thereby increasing the drain pressure. Accordingly, the discharge of detergent bubbles and wash water remaining in the drum 156 or the tub 130 may be promoted.

As such, the drain device 30, 40, and 50 in accordance with an embodiment of the present invention promotes the process of draining wash water using the siphon principle, unlike the conventional drain device using the free fall principle. Therefore, it is possible to not only drain the wash water more smoothly, but also reduce the drain time.

Figure 20:
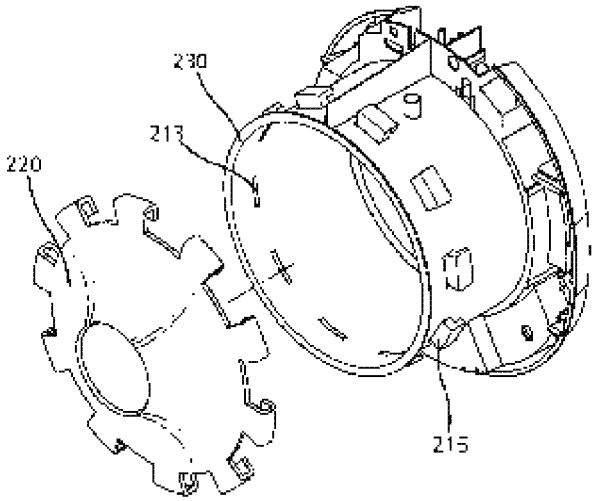
FIG. 20 is an exploded perspective view of a gasket mounting structure for a wall-mounted drum type washing machine in accordance with another embodiment of the present invention.
Figure 21:
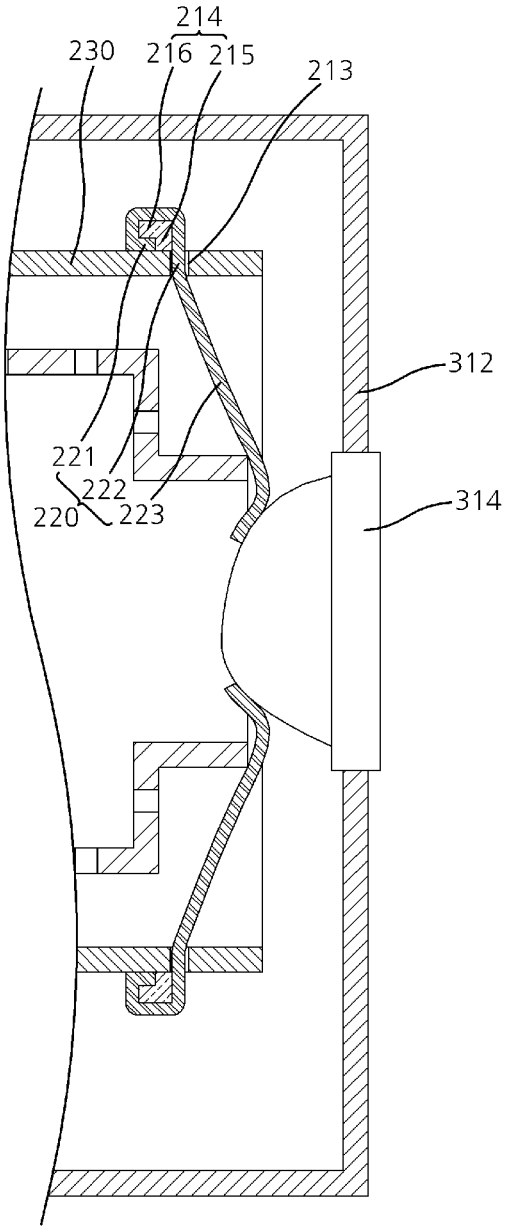
FIG. 21 is a cross-sectional view of the gasket mounting structure for the wall-mounted drum type washing machine in accordance with an embodiment of the present invention.
Figure 22:
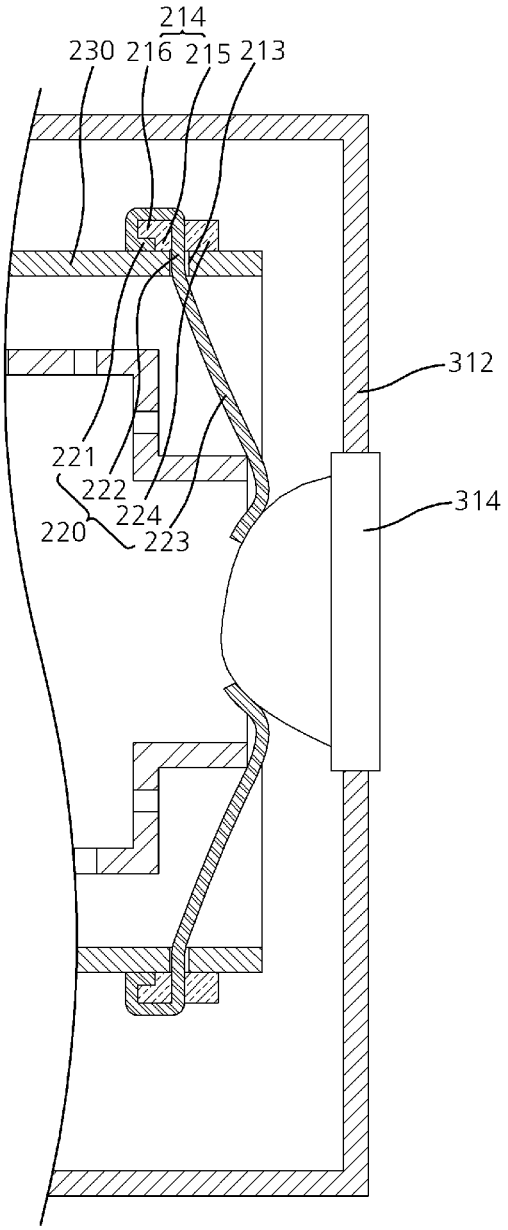
FIG. 22 is a cross-sectional view illustrating a protrusion body added to the gasket for a wall-mounted drum type washing machine in accordance with an embodiment of the present invention.
Figure 23:
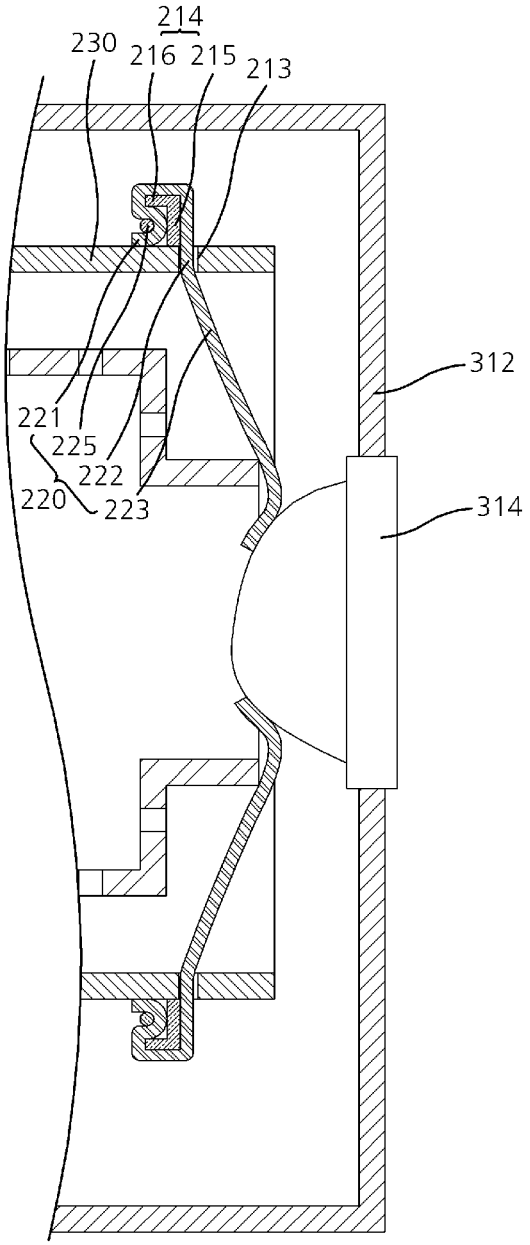
FIG. 23 is a cross-sectional view illustrating a state in which a ring spring is added to the gasket of the wall-mounted drum type washing machine in accordance with an embodiment of the present invention.

FIG. 20 is an exploded perspective view of a gasket mounting structure for a wall-mounted drum type washing machine in accordance with another embodiment of the present invention. FIG. 21 is a cross-sectional view of the gasket mounting structure of the wall-mounted drum type washing machine in accordance with an embodiment of the present invention. FIG. 22 is a cross-sectional view illustrating a protrusion gasket added to the gasket of the wall-mounted drum type washing machine in accordance with an embodiment of the present invention. FIG. 23 is a cross-sectional view illustrating a ring spring is added to the gasket for a wall-mounted drum type washing machine in accordance with an embodiment of the present invention.

Referring to FIGS. 20 to 23, the gasket 220 of the wall-mounted drum type washing machine in accordance with an embodiment of the present invention has one end portion coupled to a tub 230 and another end portion in contact with a door 314 on a cover unit 312.

The gasket 220 comprises an elastic material such as rubber, and has a wrinkled surface. Therefore, the length of the gasket 220 may vary when vibration occurs in the tub 230.

The tub 230 includes a plurality of mounting holes 213 in the front end portion thereof and a plurality of lock portions 214 that protrude from the outer circumference of thereof. The gasket 220 is locked and fixed to the lock portions 214 through the mounting holes 213.

Each of the lock portions 214 includes a coupling protrusion 215 and a lock protrusion 216.

The coupling protrusion 215 protrudes outward from the outer surface of the tub 230. The coupling protrusion 215 is adjacent to the mounting hole 213. The plurality of mounting holes 213 are arranged along the circumferential surface of the tub 230.

The lock protrusion 216 extends from the end of the coupling protrusion 215 in the opposite direction of the mounting hole 213. The lock portion 214 may include only the coupling protrusion 215, without the lock protrusion 216.

The gasket 220 in accordance with an embodiment of the present invention includes a hooked body 221, a passing body 222, and a coupling body 223.

The hooked body 221 has a hooked shape to be lock to the lock portion 214. The hooked body 221 is bent to attach to the coupling protrusion 215, and has an end locked and fixed to the lock protrusion 216.

The passing body 222 is connected to the hooked body 221, and passes through the mounting hole 213. The passing body 222 may be integral with the hooked body 221. The passing body 222 may additionally include a separate seal to prevent leakage of wash water through the mounting hole 213.

The coupling body 223 is connected to the passing body 222. The coupling body 223 may be integral with the passing body 222. The coupling body 223 contacts the door 314 and prevents wash water from leaking through a gap between the tub 230 and the door 314.

The gasket 220 in accordance with an embodiment of the present invention further includes a protrusion body 224. The protrusion body 224 is coupled to the hooked body 221, and protrudes in a side direction so as to lock to the tub 230.

The protrusion body 224 may be bonded to the hooked body 221 or integral with the hooked body 221 to contact the outer surface of the tub 230.

The end portion of the hooked body 221 inserted into the lock portion 214 has a U shape, and the gasket 220 further includes a ring spring 225. The ring spring 225 is inserted into an end portion of the hooked body 221 passing through the mounting hole 213, and attaches the hooked body 221 to the circumferential surface of the tub 230.

The ring spring 225 has a diameter corresponding to the tub 230 and surrounds the tub 230, and expands by an external force.

The end portion of the hooked body 221 is curved to closely attach to the lock protrusion 216, the coupling protrusion 215, and the tub 230, and form a space into which the ring spring 225 is inserted.

In this way, the shape of the cabinet, the connection structure of the tub, and the mounting structure of the driving unit may be improved to reduce the size of and the number of parts in the wall-mounted drum type washing machine. Accordingly, it is possible to provide a wall-mounted drum type washing machine which may be mounted in various places and perform a hot water washing operation.

Embodiments of the present invention have been disclosed above for illustrative purposes. Those skilled in the art will appreciate that various modifications, additions and substitutions are possible, without departing from the scope and spirit of the invention as disclosed in the accompanying claims.

In various embodiments of the present invention, the wall-mounted drum type washing machine has been taken as an example for description. However, this is only an example, and the wall-mounted drum type washing machine in accordance with embodiments of the present invention may be applied to other products.

The scope of the invention should be limited only by the accompanying claims.

The invention claimed is:

1. A wall-mounted drum type washing machine comprising:

a rear panel forming a rear surface of a cabinet configured to be mounted on a wall surface;

a tub installed in the cabinet to contain wash water, integrated with the rear panel, and having a rotatable drum therein;

a box unit connected to a cover unit having a door thereon, forming an outer wall of the cabinet, and coupled to the rear panel and surrounding the tub;

a water supply device configured to supply wash water into the tub through a top surface of the cabinet;

a drain device configured to discharge wash water from the tub to a bottom of the box unit and a driving unit installed on the rear panel and configured to provide power for washing operations, wherein the rear panel has a concave mounting groove on a rear surface thereof, forming a space between the wall surface and the rear surface of the rear panel, and the driving unit is connected to the drum through the rear panel and is in the mounting groove, wherein the water supply device comprises a water supply pipe configured to supply wash water to the tub through the rear panel, and wherein the water supply pipe is in a connection portion formed by cutting the top circumference of the mounting groove and has an upper end protruding from a top surface of the connection portion and a lower end connected to a rear surface of the tub, and the wall-mounted drum type washing machine further comprises:

a water supply valve connected to the water supply pipe is in the connection portion, and a cover is on the connection portion that covers the water supply valve.

2. The wall-mounted drum type washing machine of claim 1, further comprising a gasket having one end coupled to the tub and another end in contact with the door that prevents leakage of wash water from the tub and closes a gap between the cabinet and the tub.

3. The wall-mounted drum type washing machine of claim 1, further comprising a gasket wherein the tub has a mounting hole into which the gasket is inserted and a lock portion that protrudes from an outer circumferential surface of the tub and to which the gasket is locked and fixed, wherein the lock portion comprises:

a coupling protrusion that protrudes from an outer circumferential surface of the tub; and a lock protrusion extending from an end of the coupling protrusion in a lateral direction.

4. The wall-mounted drum type washing machine of claim 3, wherein the gasket comprises:

a hooked body on an inside of the lock portion and surrounding outer walls of the coupling protrusion and the lock protrusion;

a passing body protruding to the outside of the tub through the mounting hole and connected to the hooked body;

a coupling body connected to the passing body and in contact with the door; and a ring spring in an end of the hooked body configured to attach the hooked body to the tub.

5. The wall-mounted drum type washing machine of claim 1, wherein the drain device comprises:

a first drain pipe at a bottom of the tub, discharging wash water;

a second drain pipe under the first drain pipe and having a larger diameter than the first drain pipe; and a siphon between the first and second drain pipes, connecting the first and second drain pipes and applying a siphon pressure to the first drain pipe by wash water discharged from the second drain pipe.

6. The wall-mounted drum type washing machine of claim 5, wherein the siphon comprises:

a body having an introduction port connected to the first drain pipe and a discharge port connected to the second drain pipe;

a drain induction member having a cap shape inside the body and a space at a bottom thereof; and a siphon induction pipe protruding upward from a bottom surface of the body that moves wash water upward and discharges the wash water through the discharge port and maintains an interval from the drain induction member and forms a flow path.

7. The wall-mounted drum type washing machine of claim 1, wherein the rear panel is fixed to the wall surface using a fastening member fastened to the wall surface through a hole of the rear panel.

8. The wall-mounted drum type washing machine of claim 7, further comprising a buffer member between the rear panel and the wall surface to suppress vibrations generated during a washing process from being transmitted to the wall surface.

* * * * *